US011840916B2

(12) United States Patent
Ferreira Moreira et al.

(10) Patent No.: US 11,840,916 B2
(45) Date of Patent: Dec. 12, 2023

(54) SYSTEM AND METHOD FOR MONITORING ABANDONED SUBSEA WELLS WITH WET CHRISTMAS TREE

(71) Applicant: OURO NEGRO TECNOLOGIAS EM EQUIPAMENTOS INDUSTRIAIS S/A, Rio de Janeiro (BR)

(72) Inventors: Jose Roberto Ferreira Moreira, Rio de Janeiro (BR); Rafaela Campos Furtado, Rio de Janeiro (BR); Ronaldo Gonçalves Izetti, Rio de Janeiro (BR)

(73) Assignee: OURO NEGRO TECNOLOGIAS EM EQUIPAMENTOS INDUSTRAIAIS S/A, Rio de Janeiro (BR)

( * ) Notice: Subject to any disclaimer, the term of this patent is extended or adjusted under 35 U.S.C. 154(b) by 440 days.

(21) Appl. No.: 17/277,372

(22) PCT Filed: Sep. 18, 2019

(86) PCT No.: PCT/BR2019/050411
§ 371 (c)(1),
(2) Date: Mar. 18, 2021

(87) PCT Pub. No.: WO2020/056479
PCT Pub. Date: Mar. 26, 2020

(65) Prior Publication Data

US 2021/0355807 A1 Nov. 18, 2021

(30) Foreign Application Priority Data

Sep. 19, 2018 (BR) ..... 102018 069104 0

(51) Int. Cl.
*E21B 47/001* (2012.01)
*E21B 47/117* (2012.01)
(Continued)

(52) U.S. Cl.
CPC ..... *E21B 47/001* (2020.05); *E21B 33/035* (2013.01); *E21B 47/117* (2020.05); *E21B 47/12* (2013.01)

(58) Field of Classification Search
CPC .... E21B 47/001; E21B 33/035; E21B 47/117; E21B 47/12; E21B 41/0007; E21B 43/01
See application file for complete search history.

(56) References Cited

U.S. PATENT DOCUMENTS 9,410,420 B2 8/2016 Ross et al.
9,494,003 B1 * 11/2016 Carr ..... E21B 23/02
(Continued)

FOREIGN PATENT DOCUMENTS

WO WO/2018/078357 3/2018

*Primary Examiner* — Amine Benlagsir
(74) *Attorney, Agent, or Firm* — Malin Haley DiMaggio & Bowen, P.A.

(57) ABSTRACT

There is disclosed a system for monitoring abandoned subsea wells with a Wet Christmas Tree (WCT) comprising a Control Module to be installed on a modified abandonment cap and a Communication Module coupled beneath the ROV to perform the communication with the control system of the Control Module by way of an electric jumper and supply hydraulic power to the control system by way of an hydraulic jumper. The system is useful for wells with a VCM or three VCMs. In this case, the modified abandonment caps are used. The monitoring method of the abandoned subsea wells with WCT is also described.

11 Claims, 13 Drawing Sheets

(51) Int. Cl.
*E21B 33/035* (2006.01)
*E21B 47/12* (2012.01)

(56) References Cited

U.S. PATENT DOCUMENTS

| | | | | |
|---|---|---|---|---|
| 10,641,063 | B2 * | 5/2020 | Lake | B22F 5/106 |
| 2005/0217857 | A1 * | 10/2005 | Rodrigues | E21B 43/121 166/369 |
| 2006/0118310 | A1 * | 6/2006 | Euphemio | E21B 43/121 166/368 |
| 2006/0157241 | A1 * | 7/2006 | Rodrigues | E21B 43/20 166/275 |
| 2006/0231266 | A1 * | 10/2006 | Rodrigues | E21B 43/01 166/365 |
| 2007/0044972 | A1 * | 3/2007 | Roveri | E21B 43/0107 166/367 |
| 2008/0173440 | A1 * | 7/2008 | Rodrigues | E21B 43/20 166/52 |
| 2008/0210432 | A1 * | 9/2008 | Crossley | E21B 43/0175 166/357 |
| 2013/0180726 | A1 * | 7/2013 | Ross | E21B 47/12 166/336 |
| 2014/0230946 | A1 * | 8/2014 | Procida | B29C 48/11 428/188 |
| 2015/0275608 | A1 * | 10/2015 | Breda | E21B 33/0385 166/368 |
| 2016/0230531 | A1 | 8/2016 | Wood et al. | |
| 2018/0094519 | A1 | 4/2018 | Stephens et al. | |
| 2020/0190952 | A1 * | 6/2020 | Rodrigues | E21B 43/01 |

* cited by examiner

STATE OF THE ART

STATE OF THE ART

STATE OF THE ART

STATE OF THE ART

INVENTION

INVENTION

STATE OF THE ART

INVENTION

INVENTION

STATE OF THE ART

STATE OF THE ART

STATE OF THE ART

INVENTION

SYSTEM AND METHOD FOR MONITORING ABANDONED SUBSEA WELLS WITH WET CHRISTMAS TREE

FIELD OF THE INVENTION

The present invention pertains to the field of the systems and methods for monitoring abandoned subsea wells with WCT, the system comprising installing, simultaneously to the installation of the modified abandonment cap and on top of same, a Control Module and, under the ROV (Remote Operated Vehicle), a Communication Module. The Control Module enables the opening and closing of valves and the alleviation of pressures in the WCT cavities, making it possible to establish a pressure differential in the valves, which allows the desired monitoring, at the same time dispensing with the use of high cost workover rigs.

BACKGROUND OF THE INVENTION

Mature, offshore oil wells, when they are in a situation of temporary abandonment with WCT, frequently require disconnection of the collection system (see FIG. 1 appended), composed by the Vertical Connection Module, the production or injection lines, annulus and umbilical flowlines of production control of satellite subsea wells to enable demobilization of Stationary Production Units (SPU). The SPUs receive, address and distribute the production of hydrocarbons, and may also inject fluids into the reservoir. The VCM provides the interface between the lines and umbilical and the oil well, by way of the Flowline mandrel of the Production Adapter Base.

FIG. 3 shows a subsea well after the disconnection of the collection system. According to the Well Integrity Management System (WIMS) of the National Agency of Petroleum (ANP), said wells must be monitored, otherwise they should be permanently abandoned, after a maximum period of three years without monitoring. The permanent abandonment consists of the withdrawal of all the equipment from the well and the placement of cement plugs on the well. The monitoring consists of periodically verifying the integrity of the elements of the two Well Safety Barriers (WSBs) of the well. According to the WIMS, every well should operate with at least two full WSBs. The operators are most interested in postponing the permanent abandonment of these wells to improve the cash flow, due to the high cost of this operation. However, monitoring wells whose control lines and umbilical have been disconnected represents a challenge for the petroleum industry.

The temporarily abandoned wells with WCT require the installation of a conventional abandonment cap of the Flowline Hub (FLH) of the Production Adapter Base (PAB), whose function is to provide an additional static barrier which prevents the flow of hydrocarbons to the sea, considering that both the Subsurface Safety Device (SSSD), and the valves of the Wet Christmas Tree (WCT) can present trickles, tolerated by norm in the case of the SSSD, over time. The occurrence of said flows is more likely with low-pressure differential, due to the difficulty of obtaining perfect seal between the slide valves and respective seats. FIG. 4 appended shows a subsea well with a conventional abandonment cap of the FLH anchored on the FLH of the Production Adapter Base (PAB).

Wells equipped with more modern WCTs are endowed with independent flowline connectors and umbilical, so with three independent VCM, thus requiring the installation of abandonment caps on the production, annulus and umbilical hubs. FIG. 10 appended shows a subsea well with three independent Vertical Connection Modules (VCM).

Besides installing the conventional abandonment cap or caps (depending on the type of WCT) of the FLH, it is required that all the elements of the two WSB be tested, before disconnecting the lines. In other words, the WCT valves and other elements that make up the secondary WSB must be tested, as well as the SSSD and other elements that make up the primary WSB. The primary WSB, typically, is composed of: production coating, Packer, production column, gas lift valve, Surface Safety Device (SSSD), cement and cap rock. The annulus A of the well is filled with completion fluid, or with gas, if there is a gas lift raising method. The inside of the WCT and the space between the SSSD (209) and the Master Production Valve of the WCT are filled with completion fluid or ethanol or similar fluid for preventing hydrate.

Over time, there will likely be an accumulation of gas beneath the SSSD, which may allow a trickle of gas (15 scf/min) and even liquid (0.4 l/min), according to API 14B. Therefore, over many months, it is highly likely that there will be pressure equalization beneath and above the SSSD.

In the case of the WCT, similarly, due to the design of the slide WCT valves, which may allow flows with low-pressure differential, there will likely be pressure equalization in the cavity between the Master Production Valve and the SSSD and the cavity between the Master Production Valve and the Wing Production valve.

According to the WIMS, the operator should present a solution that enables the periodic monitoring of the integrity of the elements of the Well Safety Barriers (WSBs).

Ideally, according to the WIMS, the integrity of an element should be verified by periodically applying on the element the expected maximum pressure difference during productive life. The parameter to be measured is the flow by way of this element. So that this can be done in a temporarily abandoned well equipped with WCT, in principle, it is necessary to open the valves, alleviate the pressure in some of the cavities and, subsequently, apply a pressure difference on the elements of the WSBs. Obviously, there must be operating sensors to record the pressures and allow to infer the flow, based on the rise or fall time of the pressure, based on the volume and parameters of the fluid, such as temperature and composition.

The current solution for monitoring the temporarily abandoned wells, without collection system requires performing a workover operation on the well (see FIG. 7 appended). A workover rig must be sent and coupled to the WCT by way of a completion riser, with control umbilical tied. Therefore, it is possible to open and close all the valves, alleviate the pressure in the cavities, establish a pressure difference in the valves and test all the elements of the two WSBs.

Today, there are no known solutions that meet the requirements described above in an economic way, without using a workover rig, to enable temporarily abandoned wells with WCT to be monitored. The greatest challenges to monitor a subsea well without the use of a workover rig, are:

1) Open and close the WCT valves without compromising the integrity of the system. The opening of these valves by way of mechanical override is subject to failures that may prevent the closing of the valve after opening;
2) Take the pressure reading inside the WCT, even with the WCT sensors inoperative;
3) Pressurize the inside of the WCT to establish a pressure difference in the elements of the WSB and measure the flow rate by way thereof;

4) Collect and store the hydrocarbons, without polluting the sea, to enable the pressure in the cavities to be alleviated; and
5) Check the partial or total opening and closing of the WCT valves, even with the presence of ROV at the location.

Patent literature cites various documents on the subject.

Therefore, U.S. Pat. No. 9,410,420 addresses a well that comprises a hole, a wellhead and a communication box at or near to the wellhead, the well being endowed with a plurality of sensors coupled to wireless transmitters adapted to relay information from the sensors to the communication box. A first memory distant from the communication box is configured to store information from the sensors. The communication box comprises a receptor adapted to receive signals from the transmitters, and at least one from among a transmission device and a second memory device to transmit and/or store data received from the transmitters. The communication box is used to monitor a well especially before, during or after an emergency situation. The technology of this patent only allows parameters inside the well to be monitored, especially in the construction phase of the well. It does not enable the WCT valves to be actuated, nor the WCT cavities to be pressurized, nor the cavities to be alleviated, nor the flows to be measured. After all, this technology only enables the parameters inside the well to be measured, using wireless technology, especially in the event of accidents that imply the loss of conventional communication. It would not meet the requirements of the ANP. Although there is a communication box or module, the technology of U.S. Pat. No. 9,410,420 has gaps that do not make it possible to perform the operations that the technology of the invention satisfies.

The North American patent application published US20160230531A1 discloses a method and device for monitoring environmental parameters in one or more abandoned wellbores. A mandrel with a radially expandable sealing element is positioned downhole, such as in a tubing string, to provide pressure isolation. A measurement tool having one or more sensors or gauges is positioned below the mandrel to measure the environmental parameters. The data is transmitted to the surface via wire or wirelessly. Probably none of the patents cited presents a device capable of opening and closing valves to evaluate pressure, and said function must be performed by workover rig. The technology of this patent only allows parameters to be monitored inside wells abandoned. The patent cites that the well may be equipped with WCT, but does not permit the WCT valves to be actuated or pressurized in the WCT cavities, nor testing of the valves, nor alleviation of the pressure in the cavities, nor measurement of the flows. After all, this technology only allows the parameters to be measured inside the abandoned well. It would not satisfy ANP requirements.

The internationally published document WIPO Patent Application WO/2018/078357A1 describes systems and methods to help monitor conditions at an abandoned well and/or help communication with downhole communication devices. The system may comprise a processing unit in communication with the receivers, and configured to receive and process data signals from receivers located in the region near the abandoned well. The technology of this patent only allowing parameters to be monitored inside wells abandoned. The patent does not explicitly cite that the well may be equipped with WCT. It does not permit the WCT valves to be actuated or pressurized in the WCT cavities, nor the valves to be tested, nor the pressure to be alleviated in the cavities, nor the flows to be measured. After all, this technology only allows the parameters to be measured inside the abandoned well. It would not satisfy ANP requirements.

North American patent application published US 20180094519A1 describes a system that includes one or more sensors configured to generate feedback indicative of the integrity of a well. One of the sensors may be disposed in at least one annulus of a wellhead. Additionally, the system proposed in this North American patent document may include a controller coupled to the wellhead. The controller may be configured to determine, in a wireless configuration, feedback from the sensors. In some embodiments, the abandonment cap (270) may include the controller (56) of sensors coupled or placed on, or integral with the cap (270). Although this and other documents from the state of the art present controllers, sensors and other devices for monitoring parameters in wells abandoned or to be abandoned, this document and the other documents cited do not mention that the systems proposed are capable of creating pressure differences that enable the evaluation of changes in pressure over time for these wells.

The technology that is the object of the application above only allows parameters to be monitored inside abandoned wells. The patent explicitly cites that the well may be equipped with WCT, in the production phase. But it does not make it possible to actuate the WCT valves, nor pressurize the WCT cavities, nor test the valves, nor alleviate the pressure in the cavities, nor measure the flows by way of a valve, during a periodic test. It does not state that there is monitoring of wells abandoned with WCT. After all, although practically all possible types of monitoring is included, such as flow measurement and hydrocarbon detection, this technology only enables parameters to be measured inside the abandoned well. It would not satisfy ANP requirements.

Considering that, over time, all the WCT cavities will have equalized pressures, it is fundamental to establish a pressure difference to enable a valid test to be carried out on the elements of the Well Safety Barriers and determine the flow rate by way of same.

A careful examination of the recovered references shows that none of the technologies available:

Enables a Delta P to be applied on the barriers;

Enables the WCT valves to be opened and closed;

Allows the hydrocarbons to be stored and collected, without polluting the sea;

Allows the inside of the WCT to be pressurized;

Allows the total or partial opening or closing of the WCT valves to be checked by way of a position sensor.

Has a Control Module installed jointly with the modified abandonment cap of the Flowline Hub, with major cost savings;

Directly accesses the inside of the WCT, by way of the modified abandonment cap of the Flowline Hub;

Enables a check of the origin of the flow by analyzing the fluid collected;

Is explicitly intended for abandoned wells with WCT and without production lines, annulus and control umbilical; and Enables periodic testing of the seals of the abandonment caps and circular fluids in the WCT cavities, allowing the modified abandonment cap to serve as element of the secondary WSB to replace the WCT, in the event of a failure of one or more valves thereof.

Accordingly, the existing technology neither describes nor suggests the concept of the present invention as described and claimed in the present application.

SUMMARY OF THE INVENTION

Broadly speaking, the system of the invention of monitoring subsea wells to be abandoned comprises a) a Control Module; and b) a Communication Module of the ROV, where said Communication Module communicates with control element of said Control Module by way of an electric jumper and provides hydraulic power for said control element of said Control Module by way of a hydraulic jumper.

The Control Module is installed on the interface, on top of the modified abandonment cap provided by the manufacturer of the WCT, the top of the modified abandonment cap being endowed with standardized interface to enable connection on the surface.

The Communication Module is installed beneath the ROV and has the function of enabling the command of the control system of the Control Module and the obtainment of data recorded by the electronics of the Control Module, which include pressure and presence of hydrocarbons.

Therefore, the system of the invention by way of the Control Module provides devices for pressurizing and depressurizing the control lines of valves including Production and Annulus Master Valves.

The system of the invention further provides by way of the same Control Module, devices for pressurizing and depressurizing the HCR lines (High Collapse Resistance) and do loop de production, among others.

The system of the invention also provides by way of the Control Module, pressure sensors to continuously monitor the pressures in the control lines of the Master production and annulus, Crossover and Annulus Intervention valves.

The system of the invention further provides by way of the same Control Module, hydrocarbon detectors in the accesses to the production loops and annulus and in the HCR lines.

The system of the invention further provides by way of the same Control Module, a system to collect hydrocarbons and enables an analysis of the origin of a possible flow.

The system of the invention further provides by way of the same Control Module an accumulator module to supply the hydraulic power to allow the pressurization and depressurization of the hydraulic control lines of the WCT valves, enabling these valves to be opened and closed.

The system of the invention also provides by way of the same Control Module a flow meter that allows the flow to be calculated by way of the valves over time and recorded for subsequent analysis.

The system of the invention additionally provides by way of the same Control Module a control system that allows the Master Production, Master annulus, crossover and Annulus Intervention valves to be actuated.

The system of the invention additionally provides by way of the same Control Module a system that allows the position of the WCT valves to be checked, during the abandonment phase, indicating when spurious opening occurs.

The system of the invention additionally provides, by way of the same Control Module, a system that enables the seal of the modified abandonment Cap to be tested, making it feasible to maintain the well in a state of temporary abandonment, even if one or more WCT valves present flow. The temporary abandonment cap would comprise the second Well Safety Barriers, in the place of the WCT valves.

The system of the invention also provides a Communication Module to be installed beneath the ROV with the function of permitting the command of the control system of the Control Module and the obtainment of the data recorded by the electronics of the Control Module which include pressure, presence of hydrocarbons and flow rate.

DETAILED DESCRIPTION OF THE INVENTION

The present invention will be described ahead with reference to the appended Drawings, which should not be considered limitative of the invention.

Figure 1:
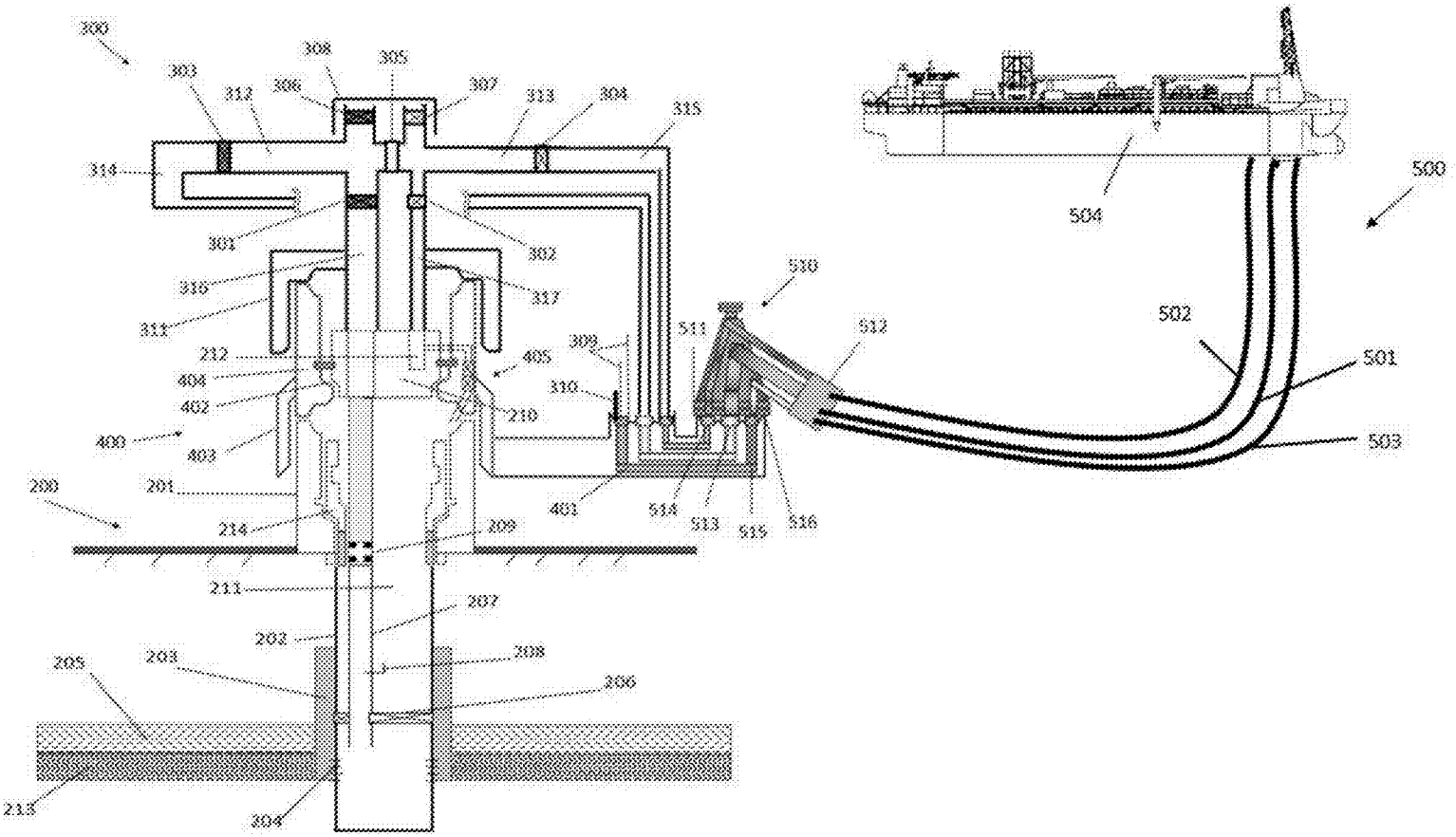
FIG. 1 appended is an illustrative scheme of a subsea well as practiced in the art, with Wet Christmas Tree (WCT) to control the flow of fluids produced and injected into the formation and Production Adapter Base (PAB), which provides a suitable interface between the WCT and the Wellhead.

FIG. 1 illustrates a subsea well (200) equipped with production column (207) and other downhole completion equipment, Wet Christmas Tree (300) and Production Adapter Base (400). The well (200) is interconnected to a collection system (500).

The Wet Christmas Tree (300) is designed to operate on the seabed and its function is to control the flow of fluids produced and injected into the formation, through perforations (204) and provide the necessary safety barriers during the production or injection phase.

According to FIG. 1, in the WCT (300), (301) is the master production valve, (302) is the master annulus valve, (303) is the production wing valve, (304) is the annulus wing valve, (305) is the valve crossover, (306) is the production swab valve, (307) is the annulus swab valve, (308) is the Tree Cap, (309) are hydraulic lines for actuating the valves, (310) are HCR lines (High Collapse Resistance) for injecting chemical products, (311) is the hydraulic Connector of the WCT (300), (312) is the Cavity on the block of the WCT (300) between the Master Production Valve (301) and the Production Wing Valve (303), (313) is the Cavity on the block of the WCT (300) between the Master annulus Valve (302) and the Annulus Wing valve (304), (314) is the cavity on the line between the production wing valve (303) and the mandrel (401) of the flowlines, (315) is the cavity on the line between the annulus wing valve (304) and the mandrel (401) of the flowlines, (316) is the cavity between the Master Production Valve (301) and the SSSD (209); and (317) is the cavity between the Master annulus Valve (302) and the tubing neck (210).

The hydraulic connector (311) of the WCT (300) can be connected directly onto the head (201) of the well or on a PAB (Production Adapter Base) (400).

A Production Adapter Base PAB (400) is endowed with the following components: (401) Flowline Hub (FLH); (402) Interface for the Tubing neck (210); (403) Hydraulic Connector; (404) High Pressure Housing (High Pressure Housing); and (405) Annulus Intervention Valves (two valves). One of the functions of the PAB (400) is to make the interface between the WCT (300) and the collection system (500), by way of the mandrel (401) of the flowlines. The other basic functions of the PAB (400) are: to provide an interface (402) for the tubing neck (210), to provide a hydraulic connector (403) to lock onto the head (201) of the well (200), to provide a high pressure housing (404) to enable the connection of the hydraulic connector (311) of the WCT (300) and to provide, in some cases, Annulus Intervention valves (405).

Figure 2:
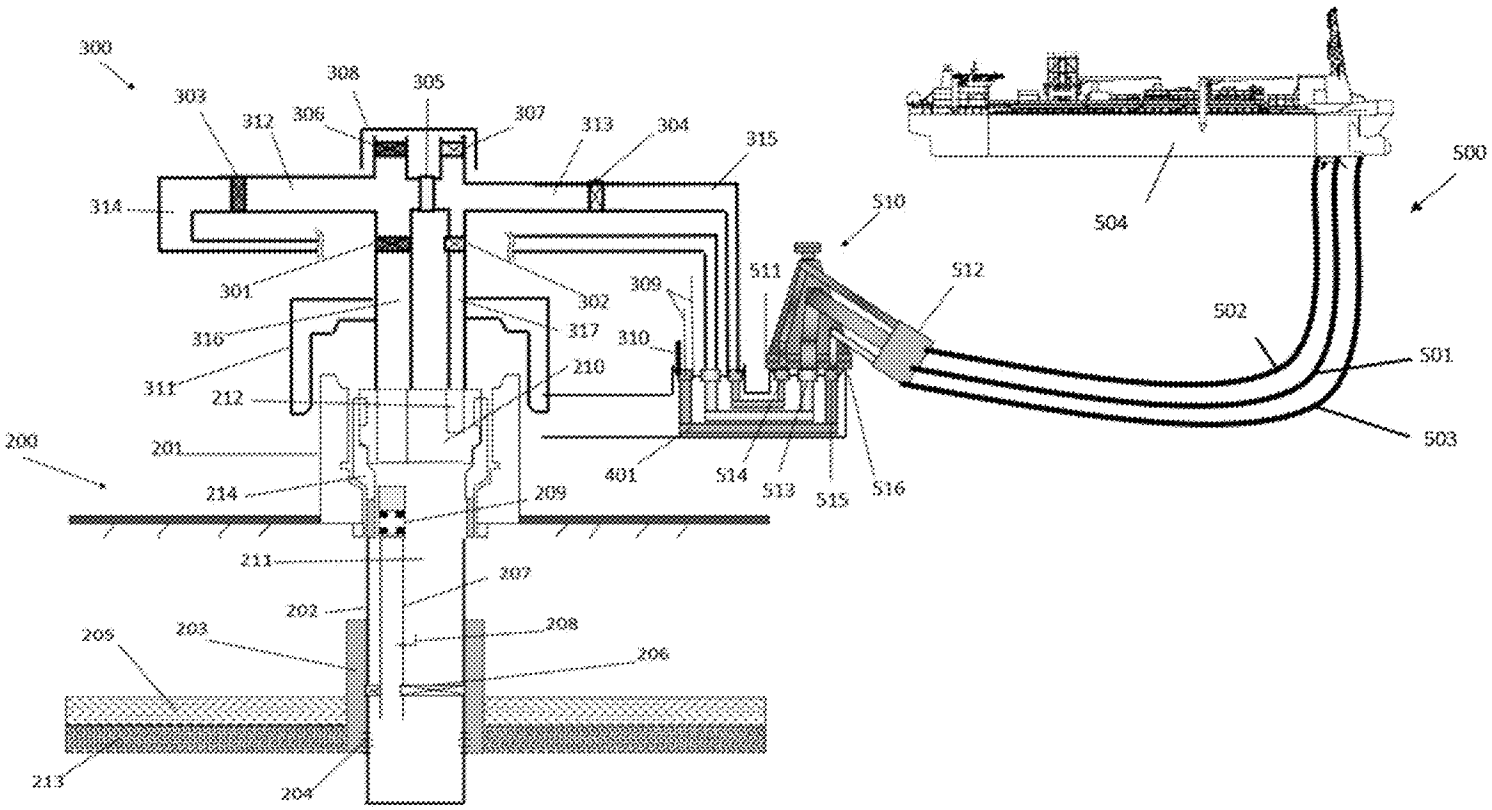
FIG. 2 appended is an illustrative scheme of a subsea well as practiced in the art similar to that of FIG. 1, but without PAB.

According to FIGS. 1 and 2 in which the production line, annulus and control umbilical are launched simultaneously by the line-launching ship and connected to a single VCM—Vertical Connection Module (510), the collection system (500) is composed of: (501) Production or Injection Line (Production or injection Flowline), (502) Annulus Flowline, (503) umbilical Production Control, (504) Stationary Production Unit (SPU), (510) VCM—Vertical Connection Module and subcomponents thereof: (511) Hydraulic Connector of the VCM, (512) Connection Flanges of the VCM to the production lines, annulus and Umbilical, (513) Seal between VCM and production bore, (514) Seal between the VCM and the annulus bore, (515) seal of the hydraulic Lines and (516) seal of the HCR lines.

The connection of the production lines (501), annulus (502) and umbilical production control (503) is made by way of a single VCM (510), which connects onto the mandrel of the flowlines (401) by way of a hydraulic connector (511). The connection of the VCM to the production lines (501), annulus (502) and production control umbilical (503) is by way of flanges (512). The VCM (510) provides seal (513) in the accesses to the production bore, seal (514) in the access to the annulus and seal (515) to the hydraulic lines of the production control umbilical and seal (516) of the HCR lines of the production control umbilical (516).

In the present application, the typical case is considered as being that which includes the PAB (400), (FIG. 1), however the concept of the invention is not limited to this configuration, being equally applicable to wells without PAB (400) (FIG. 2). In wells without PAB (FIG. 2), the production lines, annulus and umbilical are connected to the WCT (300) itself, that is, the mandrel of the flowlines (401) is located in the WCT (300). In the case of wells without PAB, the hydraulic connector (311) of the WCT (300) is connected at the wellhead (201).

Figure 4:
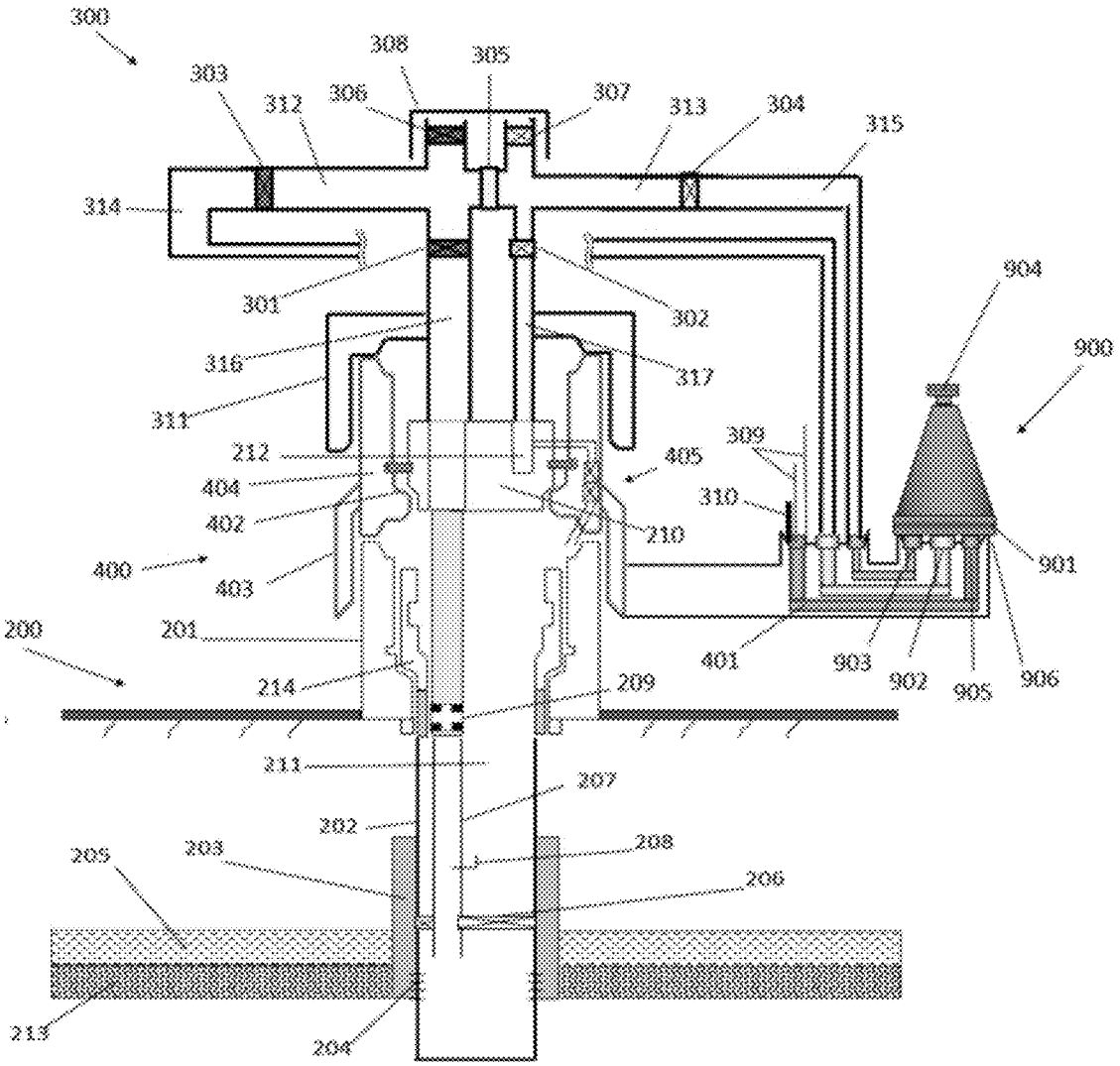
FIG. 4 appended is an illustrative scheme of the well of FIG. 3 on which a conventional abandonment cap was installed.

As already commented upon above in the present specification, the temporarily abandoned wells require the installation of a conventional abandonment cap (900) of the FLH (401) of the PAB (400), the function of which is to provide an additional static barrier which prevents the flow of hydrocarbons to the sea. Therefore, FIG. 4 shows, as practiced in the art, a subsea well with a conventional abandonment cap (900) of the FLH (401) of the PAB (400). The conventional cap (900) is endowed with a hydraulic connector (901) and an interface (904) on top of the cap for coupling on the installation tool of the cap (900). The cap (900) is basically a safety barrier which provides static metal-metal seals (902, 903, 905, 906) improved in relation to the valve seals or elastomer seals.

Figure 3:
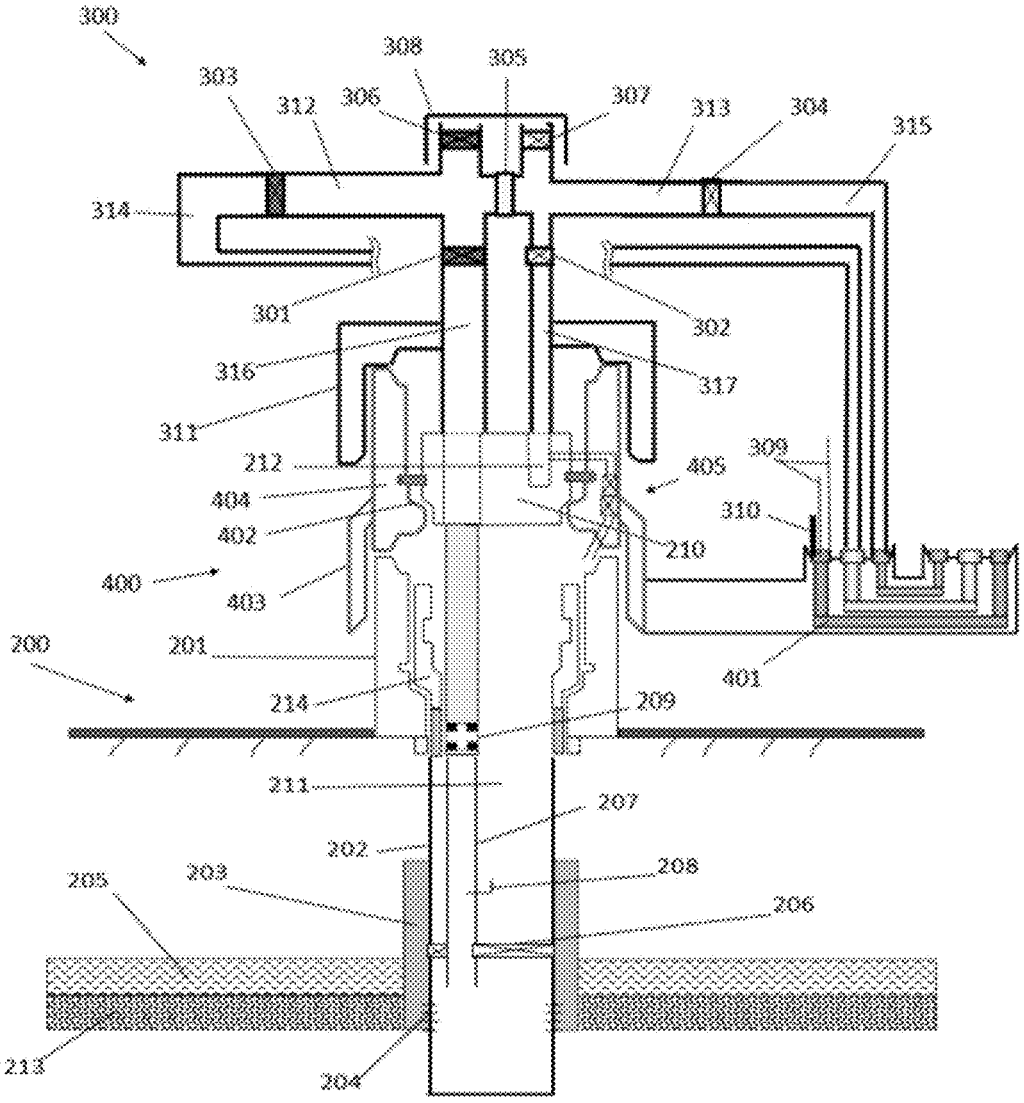
FIG. 3 appended is an illustrative scheme of a subsea well after the disconnection of the collection system and thus should be monitored according to the requirements of the Regulatory Agency or permanently abandoned.
Figure 11:
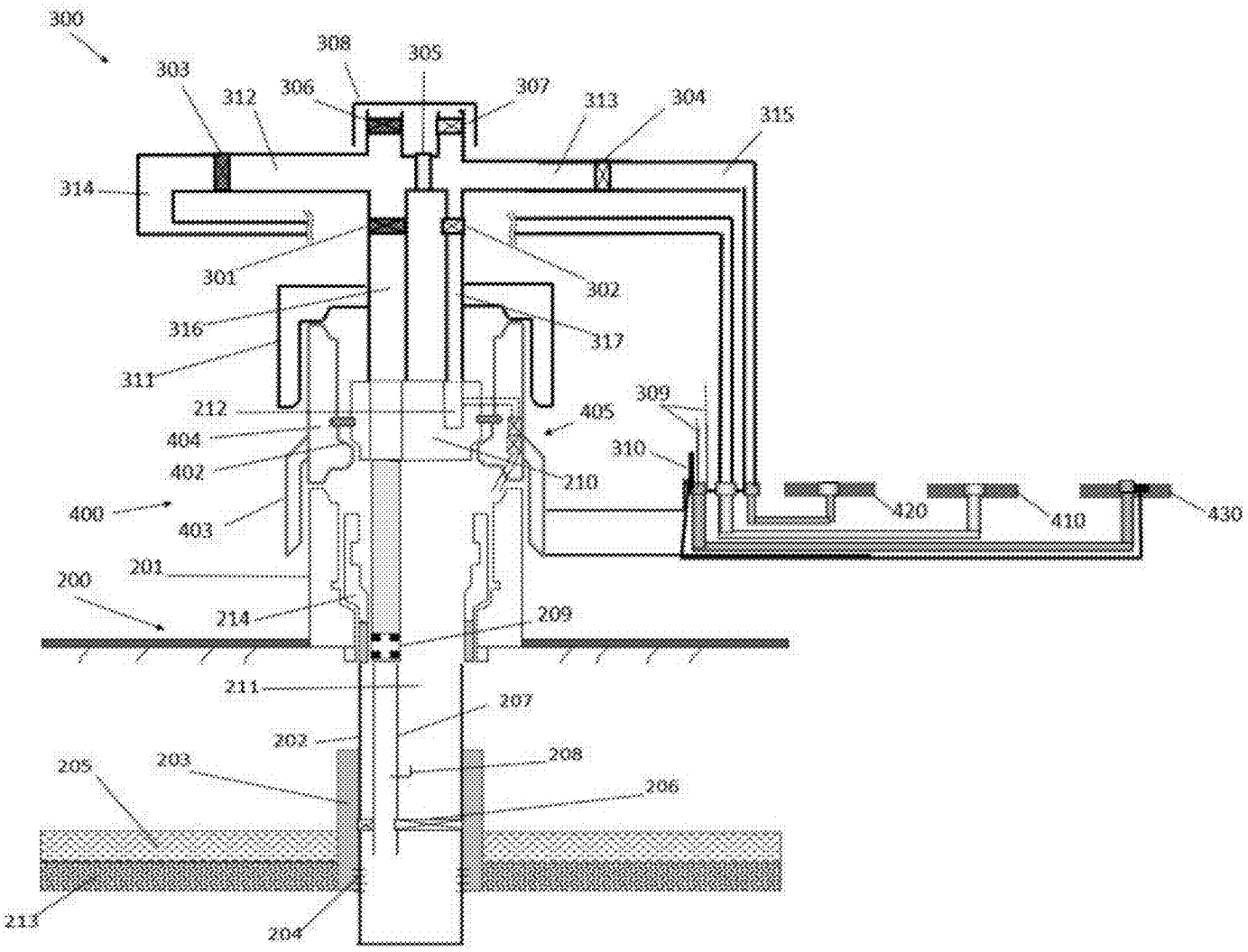
FIG. 11 appended is an illustrative scheme according to the state of the art of the subsea well of FIG. 10 after the removal of the collection system.

In relation to the conventional abandonment caps, (all of them) just have the function of acting as safety barrier, providing seal of the accesses to the WCT and PAB which are made through the production lines (501), annulus flowline (502) and HCR and hydraulic lines of the umbilical (503), when the VCM is installed. These accesses are exposed when the VCM (or the three VCM) is withdrawn (FIGS. 3 and 11). If there were no abandonment cap, the accesses to the WCT and PAB would be in direct contact with sea water, after the withdrawal of the VCM. The conventional abandonment cap enables the testing, during installation, of the seals only inwardly.

In order to adjust the conventional abandonment cap to the needs of the invention, changes were made to an abandonment cap.

It should be quite clear to specialists that the changes made on said abandonment cap are achievable by a person skilled in the art and do not constitute the object of the invention.

The modified abandonment cap, besides acting as safety barrier, like the conventional cap, has inner holes that enable, by way of the HCR lines (118), the connection in the cavities (312, 313, 314, 315, 316, 317) to elements (102, 103, 104, 105, 106, 107) of the Control Module (100), whereby enabling: measure the pressure of the WCT cavities, measure the flow by way of valves, detect the presence of hydrocarbons in the cavities (312, 313, 314, 315, 316, 317) of the WCT, pressurizing and depressurizing said cavities. Additionally, it enables, by way of the hydraulic lines (117), the pressurization of the control lines (309) of the WCT valves (300), enabling said valves to be opened and closed. Additionally, the modified abandonment cap, allows periodic testing of the seals that act as safety barrier (601, 602, 603, 605, 606) in the case of a VCM and (612, 622, 632) in the event of three VCM. This test can be made in the two directions of the seal (inwardly and outwardly), making the test more reliable and applied in the read direction of a possible flow, that is, outwardly.

Figure 5:
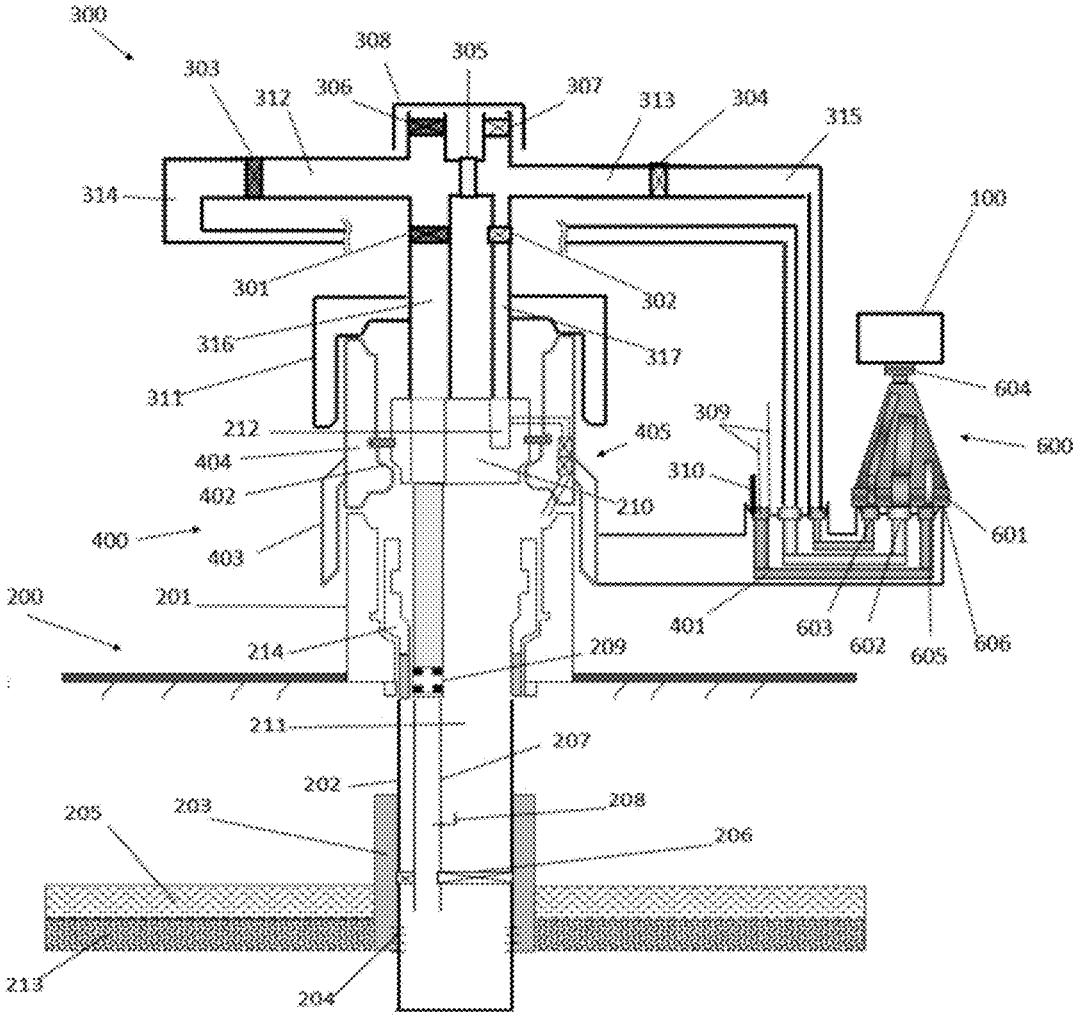
FIG. 5 appended is an illustrative scheme of the well of FIG. 4 showing the modified abandonment cap and, thereon, the Control Module according to the invention.

FIG. 5 shows a subsea well with the modified abandonment cap (600) of the FLH (401) according to the invention.

The modified cap (600) also is endowed with a hydraulic connector (601) that enables the locking on the upper profile of the FLH (401) of the PAB (400). The modified cap (600) also has the function of safety barrier which provides static metal-metal seals (601, 602, 603, 605, 606) improved in relation to the valve seals or elastomer seals. The modified cap (600) is further endowed with an outer seal (607) which creates a cavity (608) around the static metal-metal seals (601, 602, 603, 605, 606), enabling the seals to be tested. Therefore, the modified cap (600) may be part of the secondary WSB, in the case of flow of one or more WCT valves (300).

Contrary to the conventional cap (900), the modified cap (600) provides access to the Control Module (100) for pressurizing/depressurizing the: i) cavity (312) on the block of the WCT (300) between the Master Production Valve (301) and the Production Wing Valve (303); ii) of the Cavity (313) on the block of the WCT (300) between the Master annulus Valve (302) and the Wing Annulus valve (304); iii) of the cavity (314) on the line between the production wing valve (303) and the mandrel (401) of the flowlines; iv) of the cavity (315) on the line between the annulus wing valve (304) and the mandrel (401) of the flowlines; v) of the cavity (316) between the Master Production Valve (301) and the SSSD (209); vi) of the cavity (317) between the Master annulus Valve (302) and the tubing neck (210); and of the cavity (608).

There is additionally provided an interface (604) on top of the modified cap (600) for coupling the Control Module (100) and hydraulic accesses by way of the seals metal-metal (605, 606) to allow pressurization of the hydraulic lines (309) of the WCT (300) and HCR lines (310).

Wells equipped with more modern WCTs (300) are endowed with independent flowline connectors and umbilical, thus requiring the installation of abandonment caps in the production, annulus and umbilical hubs. In this case, the launch of the flowlines and umbilical is made in individual maneuvers. The present application also envisages this case, which is explained in greater detail ahead in the present specification.

Figure 6:
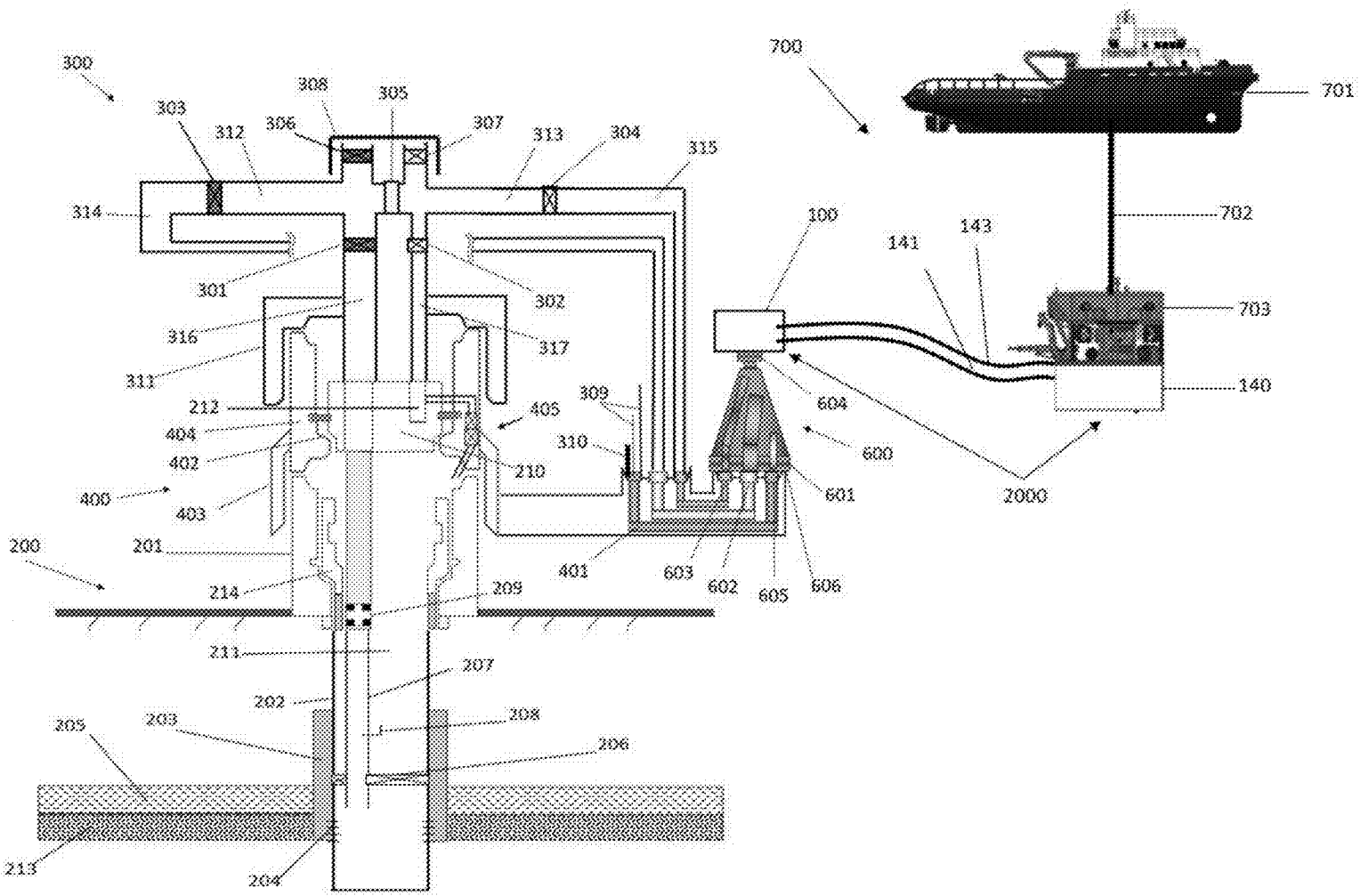
FIG. 6 appended is an illustrative scheme of the operation of monitoring a subsea well using the system of the invention with the modified abandonment cap on which the Control Module and the ROV with Communication Module was installed.
Figure 7:
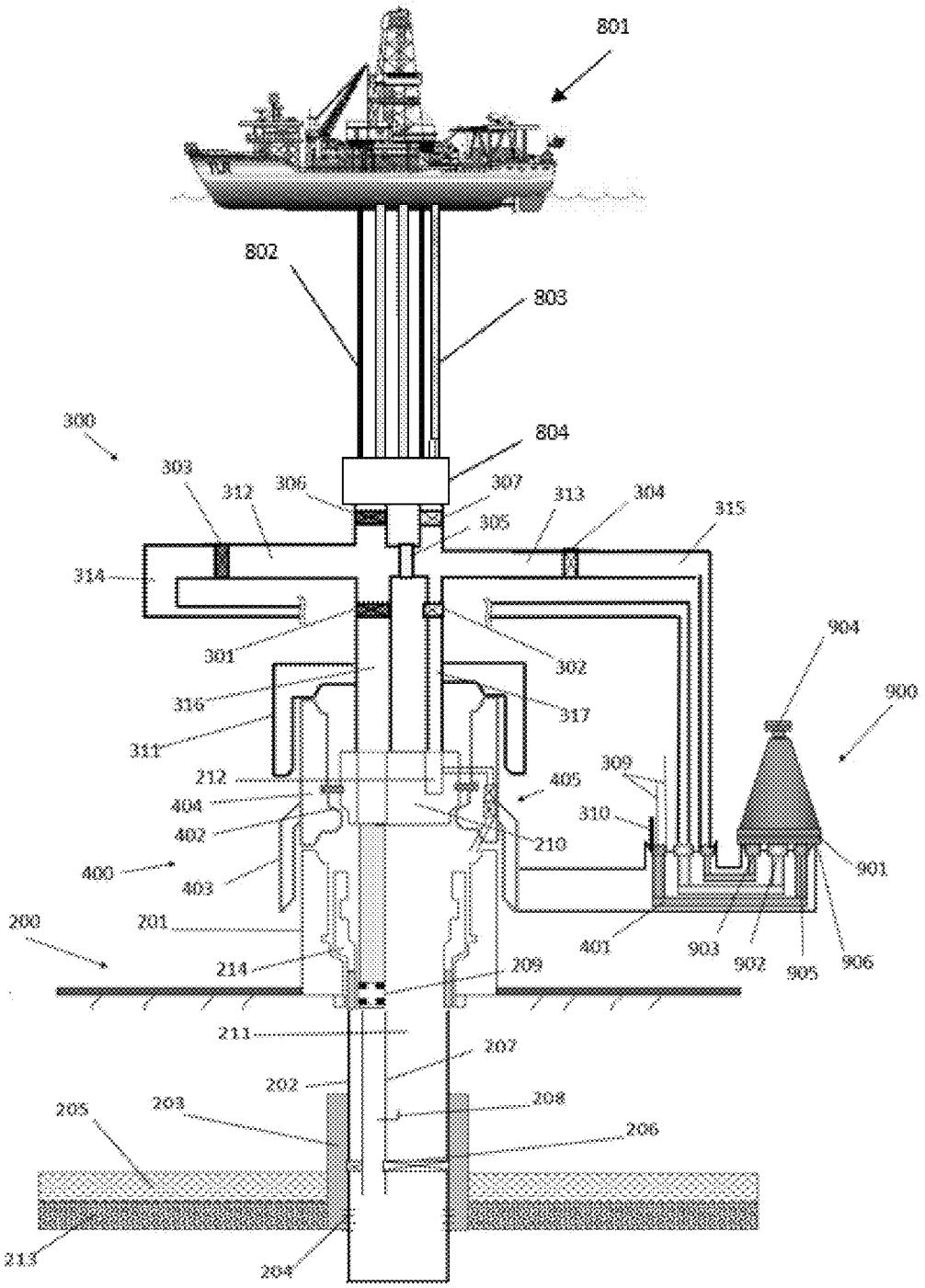
FIG. 7 appended is an illustrative scheme of the operation of monitoring a subsea abandoned well with WCT, using a workover rig utilized in the state of the art to perform the opening and closing of valves necessary for monitoring wells that are abandoned or to be abandoned.
Figure 8:
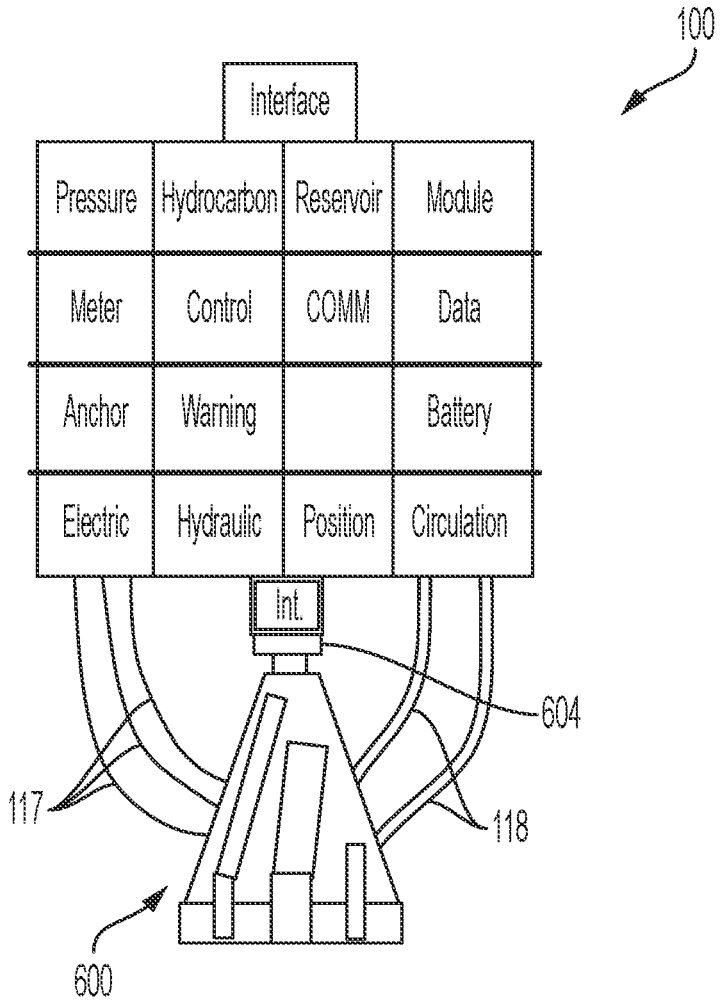
FIG. 8 appended is an illustrative scheme of the components of the Control Module of the invention, installed on the modified abandonment cap of the subsea well.

According to the invention and as can be seen in FIGS. 5, 6 and 8, the Control Module, generally designated by the number (100), is installed on the standardized interface (604), on top of the modified abandonment cap (600) furnished by the manufacturer of the WCT (300). The standardized interface (604) (selected from among an API flange, but not limited thereto) should allow the connection, on the surface, of the control module (100).

The Control Module (100) and its subcomponents are shown, merely schematically, not necessarily in the real position, in FIG. 8 appended.

The System of the invention is generally indicated by the number (2000), see FIG. 6.

According to the invention, the System of Monitoring Abandoned Subsea Wells with Wet Christmas Tree comprises:

a) A Control Module (100) and, on top of said Module (100), a mechanical interface (101) designed to couple onto the installation tool (not represented) of the Module (100), to be installed by a vessel (not represented) jointly with the abandonment cap (600). The mechanical interface (101) should be located on the axis of the center of gravity of the modified abandonment cap (600) to prevent misalignment, during coupling to the mandrel (401) of the flowlines of the PAB (400). The interface (101) should be sized to support all the strain generated during the installation of the abandonment cap (600) jointly with the Control Module (100);

b) At the base of said Module (100), an interface (116) for coupling the standardized interface (604) positioned on top of the modified abandonment cap (600);

c) At least one hydraulic line (117) connected to the modified abandonment cap (600) for pressurizing and depressurizing the control lines (309) of the valves: Master Production (301) and annulus (302), Crossover (305) and Annulus Intervention (405) (if such exist). The module (100) is further endowed with lines (118) for pressurizing and depressurizing the HCR lines (High Collapse Resistance) (310) (if such exist) and also pressurizing the cavities (312, 314, 313, 315) of the WCT (300);

d) Pressure sensors (102) for continuously monitoring the pressures in the control lines (309) of the Master production (301) and annulus (302), Crossover (305) and Annulus Intervention (405) valves (if such exist), on the HCR lines (310) and in the cavities (312, 314, 313, 315) of the WCT (300);

e) Position sensors (119) of the WCT valves (300), making it possible to determine the partial or total opening and closing of the Master production (301) and annulus (302), Crossover (305) and Annulus Intervention (405) valves (if such exist). During the abandonment phase, if there is a spurious opening of one of these valves, a warning signal is issued, selected from among sound, electromagnetic, laser or pressure pulse;

f) hydrocarbon detectors (103) in the cavities (312, 314, 313, 315) of the WCT (300) by way of the lines (118);

g) a compensating reservoir (104), recoverable by ROV (703), to alleviate the pressure of the cavities (312, 314, 313, 315) of the WCT (300) and store hydrocarbons, when necessary, with risk of polluting the sea. By analyzing the hydrocarbons collected, it will be possible to determine the composition of the hydrocarbons with a view to determining the point of origin of the flow;

h) an accumulator module (105) to supply the hydraulic power to allow the pressurization and depressurization of the hydraulic control lines (309) of the WCT valves (300), for opening and closing the Master Production (301) and Master Annulus (302), Crossover (305) and Annulus Intervention (405) valves (as applicable);

i) a flow meter (106) for calculating the flow by way of the valves over time and recording the values measured for subsequent analysis;

j) a control system (107) for actuating the Master Production (301) and Master Annulus (302), Crossover (305) and Annulus Intervention (405) valves (as applicable); and k) A Communication Module (140) coupled beneath the ROV (703) to perform the communication with the control system (107), by way of an electric jumper (143) (see FIG. 6 appended) and supply hydraulic power to the control system (107) by way of um hydraulic jumper (141). The communication module (140) is also equipped with a system that allows the following types of communication with the control system (107): sound communication, laser, electromagnetic or pressure pulse, besides the electric jumper (143).

Figure 9:
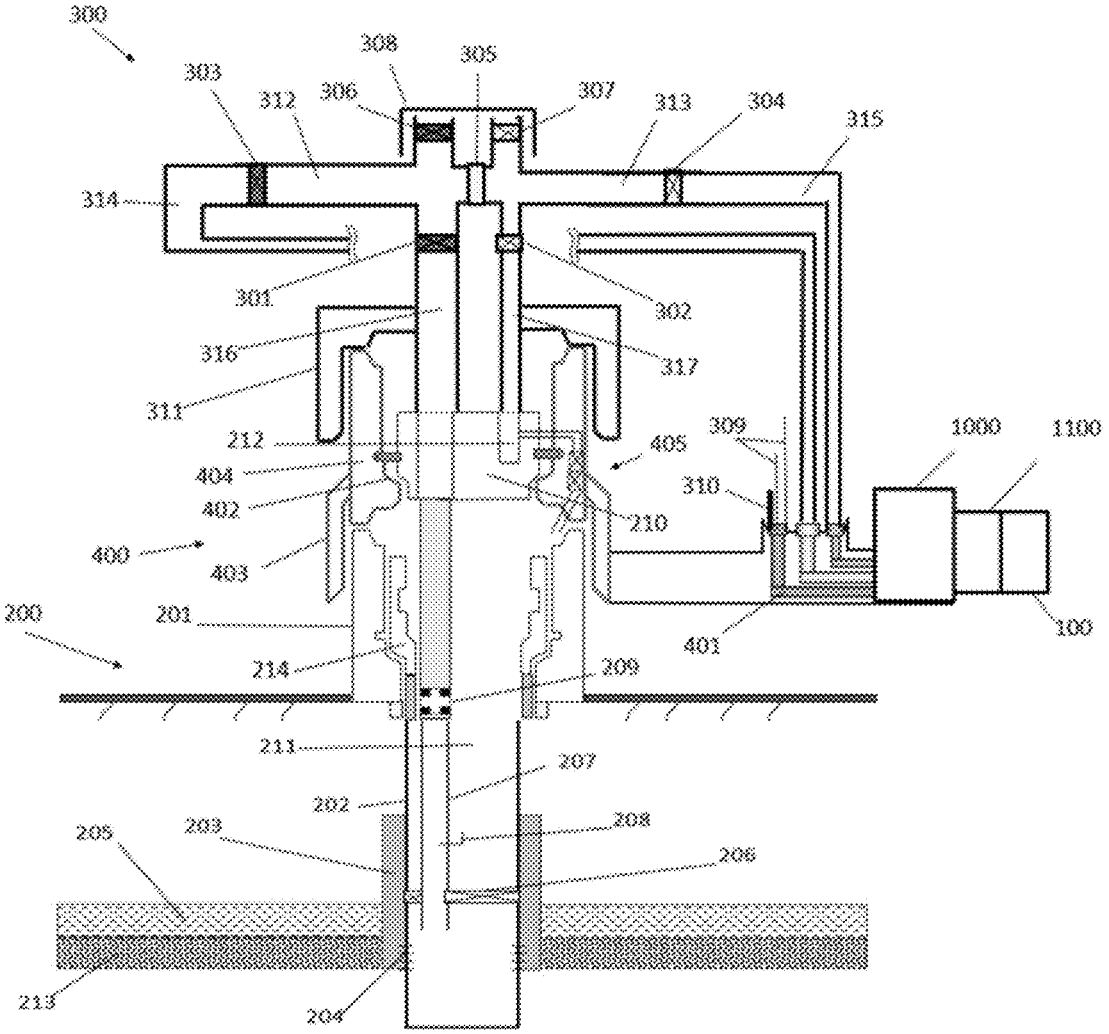
FIG. 9 appended is a schematic alternative configuration of the system of the invention, in which the Control Module is installed on WCT with a system of horizontal connection lines.

The Control Module is additionally endowed with:

a) a communication system (108) that allows the dispatch to the Module (140) coupled beneath the ROV (703)$_7$ using sound or laser or electromagnetic communication, or pressure pulse, or by way of an electric jumper (143), the record, over time, of pressure and flow in the various sensors of the WCT (300), besides the presence of hydrocarbons;

b) a data module (109), recoverable by ROV, which enables the obtainment of all the records on pressure, presence of hydrocarbons, flow by way of the valves at intervals set by the operator and position of the Master Production (301) and Master Annulus (302), Crossover (305) and Annulus Intervention (405) valves (if such exist). The data module (109) is endowed with batteries and allows the installation of another module similar (not represented), with assistance of ROV (703), after the withdrawal of the preceding one;

c) an anchoring point (110). for the ROV (703) with five-function arm;

d) a warning module (111) which detaches from the control module (100) should an event occur, preset by the operator such as flow by way of the valves greater than the limit or spurious opening of a valve. The warning module (111) is endowed with buoyance and emits radio or sound signals, upon reaching the surface, allowing the location thereof and identification of the well, as well as the type of problem detected and the respective records;

e) at least one control line (117) for actuation of the WCT valves (300) and PAB (400);

f) a battery module (113) to fee the entire electronics of the Module (100);

g) a sensor module (119) for detecting the position of the WCT valves (300) by way of sensors installed on the panel for indicating the position of the valves. If there is spurious movement of the valves, the sensor module warns as such; and h) a circulation module (120), endowed with a circulation valve for communication between the cavities (314, 315), enabling the circulation of fluids and cleaning of hydrocarbons by the workover rig (801), if there is need to withdraw the WCT (300) or modified cap (600), whereby preventing pollution of the sea. The circulation module (120) also makes it possible to dislocate the hydrocarbons in the cavities (314,315) towards the compensating reservoir (104). Alternatively, the control module (100) is installed in WCT (300) with a system (1000) of horizontal connection lines jointly with the horizontal abandonment cap (1100) of the FLH (401) (FIG. 9).

The main components of the system of installing (700) the Communication Module (140) are: (701)—RSV—ROV Support Vessel; (702) Umbilical of the ROV and (703)—ROV—Remote Operated Vehicle (FIG. 6), the communication between the control panel on board the RSV (701) and the Control Module is done, preferably, by way of the umbilical of the ROV, but can also be done without the assistance of the ROV, by way of sound or electromagnetic communication, pressure pulse, laser, directly with the control module (100).

Another embodiment of the invention envisages the application of the system (2000) and method of the invention for wells with independent flowline connectors. One scheme from the state of the art for this type of wells is illustrated in FIG. 10.

Figure 10:
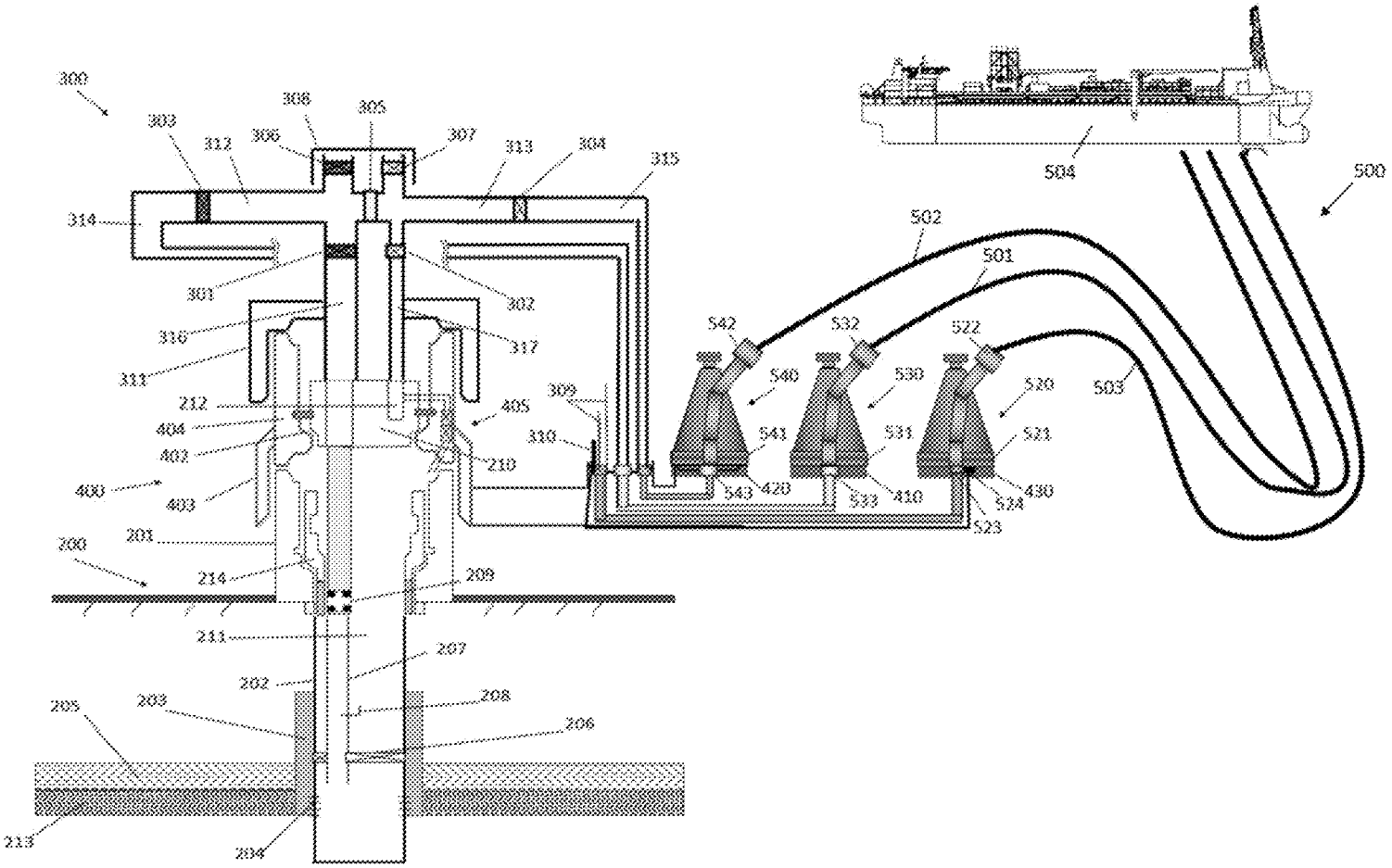
FIG. 10 appended is an illustrative scheme according to the state of the art of a collection system for wells with independent flowlines.

With the increase in the water depth, the total weight of the production lines, annulus and umbilical exceeds the capacity of the launch vessels, requiring the separate launch of each one of these lines and, consequently, the use of independent flowline connectors, as shown in FIG. 10. In this case, the collection system (500) comprises: (501)—Production or Injection Line (Production or injection Flowline); (502)—Annulus Flowline (Annulus Flowline); (503)—umbilical Production control; (504)—Stationary Production Unit (SPU), (520)—VCMU—Vertical Connection Module of the Umbilical (530)—PVCM—Vertical Connection Module of Production and (540)—AVCM—Annual Vertical Connection Module.

The VCMU—Vertical Connection Module of the Umbilical (520) comprises (521)—Hydraulic Connector of the VCMU; (522)—Connection Flange of the VCMU to the production umbilical; (523)—Seals between VCMU and HCR lines; (524)—Interface for hydraulic Lines; (525)—Interface for the HCR lines; (525)—hydraulic Jumper interface with the WCT (300).

The PVCM—Vertical Connection Module of Production (530) comprises (531) Hydraulic Connector of the PVCM; (532)—Connection Flange of the PVCM to the production line; (533)—Seals between PVCM and production bore.

The AVCM—Annual Vertical Connection Module (540) comprises (541)—Hydraulic Connector of the PVCM; (542)—Connection Flange of the PVCM to the production line and (543)—Seals between PVCM and production bore.

In this case, the PAB (400) is endowed with three mandrels: (410)—Production Flow Line Mandrel (PFLM); (420)—Annulus Flow Line Mandrel (AFLM) and (430)—Production Umbilical Mandrel (PUM).

FIG. 11 shows the subsea well of FIG. 10 after the removal of the collection system endowed with three VCMs.

Figure 12:
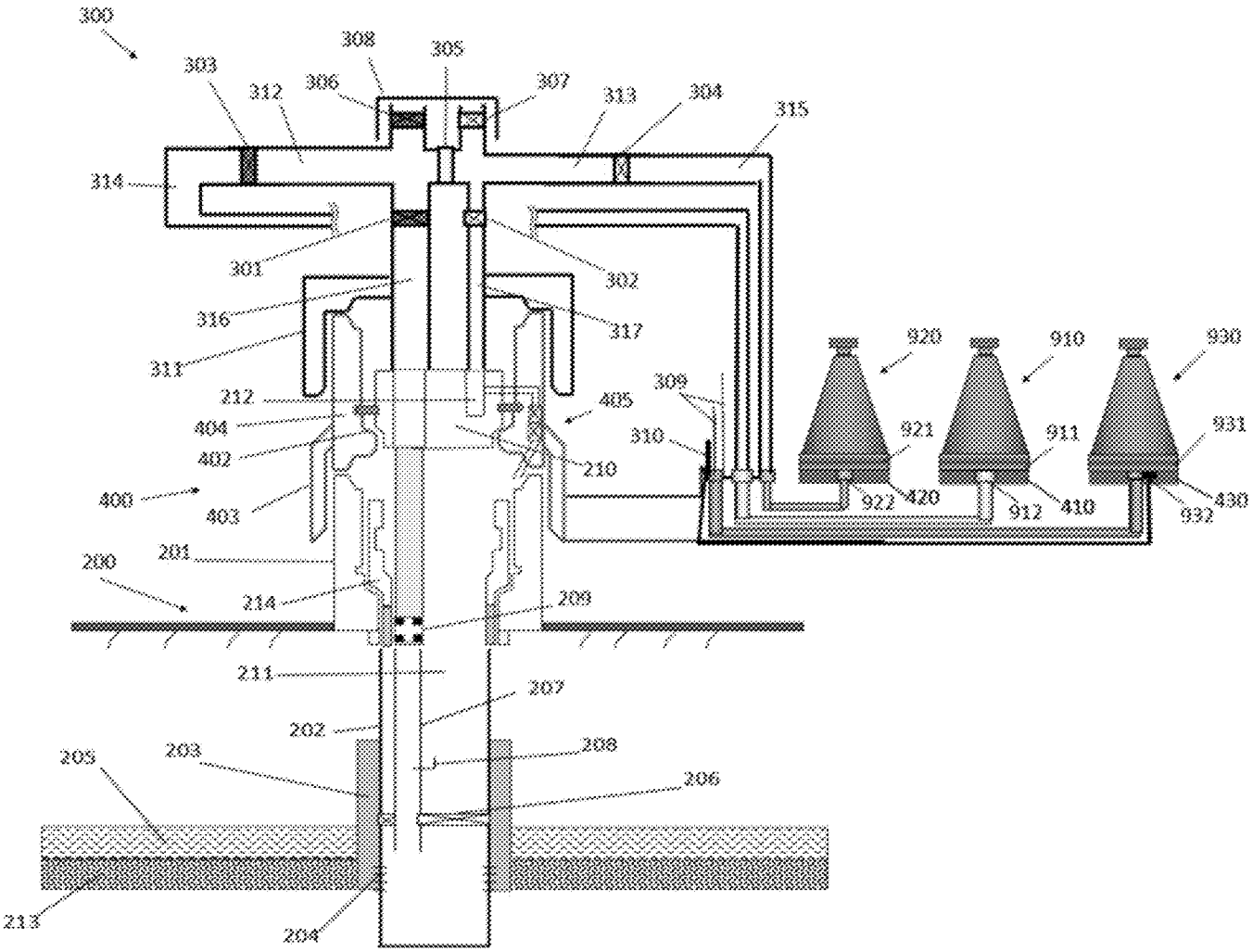
FIG. 12 appended is an illustrative scheme according to the state of the art of the subsea well of FIG. 10 with the abandonment cap of the PUM, the abandonment cap of the PFLM and the abandonment cap of the AFLM.

FIG. 12 shows the subsea well after the installation of conventional abandonment caps according to the state of the art. In this case, there are three conventional abandonment caps: (910)—Abandonment Cap of the PFLM (410); (611)—hydraulic Connector of the abandonment cap of the PFLM (410); (612)—Seal of the production bore at the interface with the PFLM (410); (920)—Conventional Abandonment Cap of the AFLM (420); (621)—hydraulic Connector of the abandonment cap of the AFLM (420); (622)—Seal of the annulus bore on the interface with the AFLM (420); (930)—Conventional abandonment cap of the PUM (430); (631)—hydraulic Connector of the abandonment cap of the PUM (430); (632)—Seal of the HCR bores at the interface with the PUM (430);

The conventional abandonment cap (910) of the PFLM (410) has the function of sealing only the production bore (533) of the PFLM (410).

The conventional abandonment cap (920) of the AFLM (420) has the function of sealing only the annulus bore (543) of the AFLM (420).

The conventional abandonment cap (930) of the PUM (430) has the function of sealing only the bore (523) of the HCR lines (431).

Figure 13:
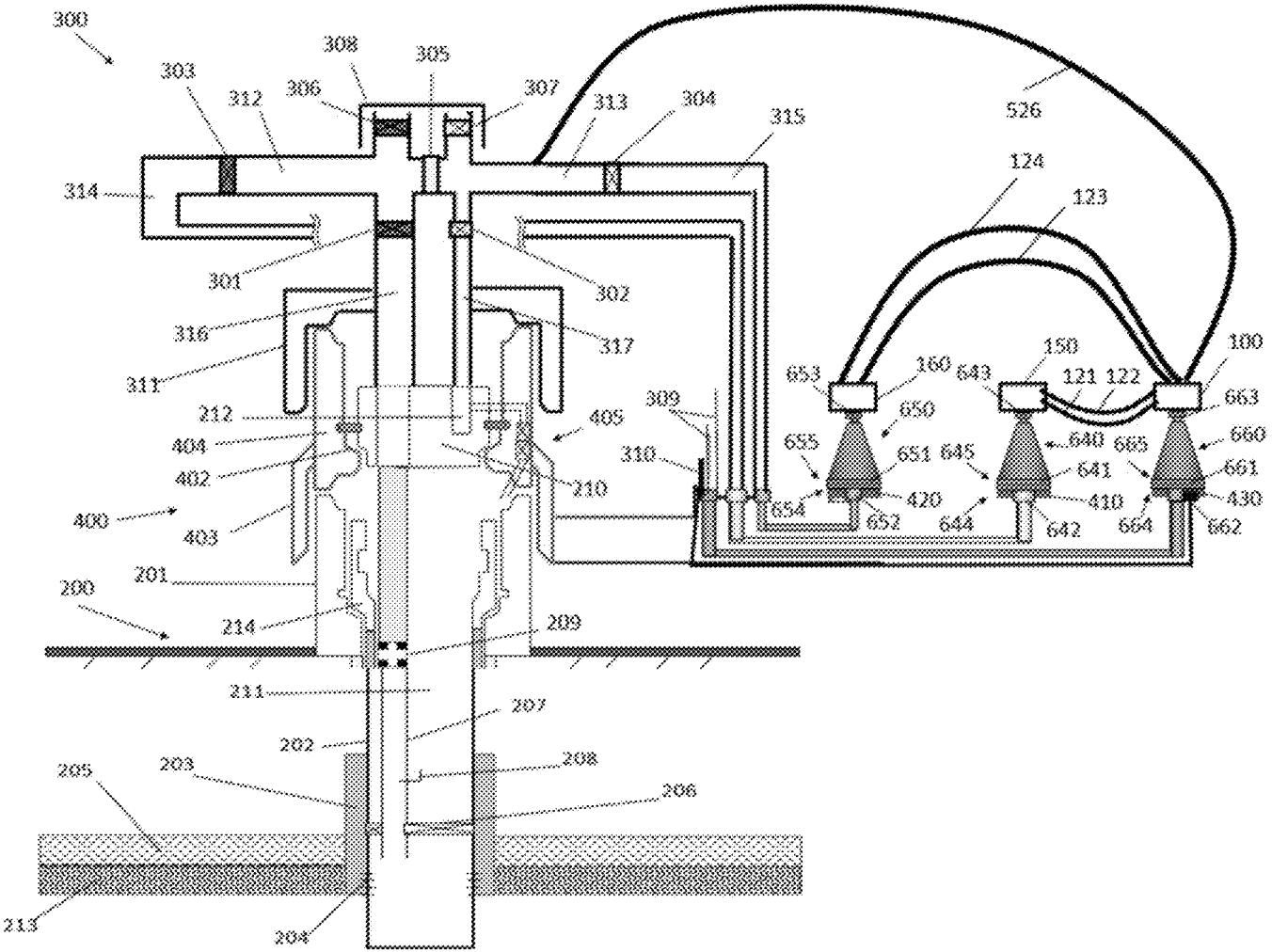
FIG. 13 appended is an illustrative scheme according to the invention for the Modified abandonment Cap of the PUM with the Control Module, the modified abandonment cap of the PFLM with the Production Pressure Register Module and the modified abandonment cap of the AFLM with the Annual Pressure Register Module.

FIG. 13 shows an embodiment of the system (2000) of the invention with a Modified abandonment Cap (660) of the PUM (430) with the Control Module (100), the modified abandonment cap (640) of the PFLM (410) with the Production Pressure Register Module (150) and the modified abandonment cap (650) of the AFLM (420) with the Annual Pressure Register Module (160).

For matters of clarity of the drawing, the Communication Module (140) is not represented in FIG. 13.

The modified abandonment cap (660) of the PUM (430) is endowed with a hydraulic connector (661) for locking onto the PUM (430), a standardized interface (663) on top for connecting onto the interface (116) of the control Module (100) and an outer seal (664) which forms a cavity (665) around the seals of the HCR lines (662).

The modified abandonment cap (640) of the PFLM (410) is endowed with um hydraulic connector (641) for locking onto the AFLM (420), a standardized interface (643) for connecting onto the Production Pressure Register Module (150) and an outer seal (644) which forms a cavity (645) around the seal (642) of the annulus bore.

The modified abandonment cap (650) of the AFLM (420) is endowed with a hydraulic connector (651) for locking onto the AFLM (420), a standardized interface (653) for connecting on the Annual Pressure Register Module (160) and an outer seal (654) which forms a cavity (655) around the seal (652) of the annulus bore.

Each modified abandonment cap (640,650,660) is installed jointly with its respective module (150,160,100), similarly to that described for WCT with only one VCM.

The function of the Production Pressure Register Module (150) is solely to provide hydraulic access of the Control Module (100) to the cavity (314) and to the cavity (645) for testing the seal (642). The function of the Annual Pressure Register Module (160) is solely to provide hydraulic access of the Control Module (100) to the cavity (315) and to the cavity (655) for testing the seal (652).

In this embodiment, the Control Module (100) presents the following differences in relation to the case described previously in the present specification, relating to a single VCM:

a) It is installed on top of the abandonment cap (660) of the PUM (430) instead of on top of the abandonment cap (630) of the FLH (401);

b) It is endowed with an interface (not represented) for hydraulic feed, by way of HCR production hose (121), to the Production Pressure Register Module (150) and an interface for hydraulic feed by way of annulus HCR hose (123), to the Annual Pressure Register Module (160). It is additionally endowed with a hydraulic line (122) for connection to the cavity (645) and a hydraulic line (124) for connection to the cavity (655);

c) It is endowed with an interface (not represented) for connecting the hydraulic jumper (526) to the WCT (300), for controlling the WCT valves (300). The hydraulic jumper (526) is represented in FIG. 13 as being connected to the WCT (300) at a specific point solely for ease of representation, since said jumper (526) is connected at the point of the WCT (300) most suited to each case.

Next there is described the monitoring method for subsea wells with Wet Christmas Tree according to the invention. As can be noted, the present method is applicable, with minor changes achievable by a person skilled in the art, both for the case of a well with a single VCM (510) (and a Modified Abandonment Cap (600) and for a well with up to three VCMs (520, 530 540) (and three modified caps (640, 650,660).

Therefore, the embodiments for abandoned subsea wells with Wet Christmas Tree with a single VCM or with up to three VCMs fully fall within the scope of the present invention as described in the present specification and accompanying claims.

Installing the Control Module (100) jointly with the modified abandonment cap (600), in the case of a VCM or on the modified cap (660), in the case of 3 VCM. In this case, the Production Pressure Register Module (150) on the modified cap (640) and the Annual Pressure Register Module (160) on the modified cap (650) would also be installed;

After the installation of said Control Module (100), jointly with the Abandonment Cap (600), or, in the case of 3 VCM, also the Production Pressure Register Module (150) on the modified cap (640) and the Annual Pressure Register Module (160) on the modified cap (650), the WCT valves (300) are all closed and inside of the WCT (300) filled with hydrate inhibitor;

The Control Module (100) continuously records and stores the data on pressures and presence of hydrocarbons, in addition to the composition of the hydrocarbons; if any abnormality is detected in the well, such as flow by way of the valves over the limit or presence of hydrocarbons, or spurious opening of the valves, the warning module (111) will be detached and its floats will make it emerge on the surface of the sea; the warning module (111) will then begin transmitting radio or sound signals such that the location of the well and the data on the abnormality be known, enabling immediate action to remedy the problem; a new warning module may be installed by ROV (703);

Once the interval between periodic inspections has elapsed, determined by the operator, an RSV—ROV Support Vessel (701) is sent to perform the monitoring of the well (see FIG. 6); —The RSV (701) launches the ROV (703) by way of a launch and control umbilical (702);

the ROV (703) is sent down with the communication module (140) of the ROV coupled;—with assistance of the ROV, make the connection of the electric jumper (143) of the communication module (140) to the electric connector (114) of the control Module (100);

Also with the assistance of the ROV (703) make the connection of the hydraulic Jumper (141) of the Communication Module (140) to the hydraulic receptacle (115) in the Control Module (100);

Perform the integrity test of the Wing Production (303) and master Production (301) Valves (with test in the counter direction of the flow). using the control system (107) of the control module (100); for such, pressurize the cavity (312) between the Master Production (301) and Wing Production (303) Valves and note whether there is a drop in pressure in this cavity and rise in pressure in the cavity (314) and if so, calculate the flow; obviously, there must be one delta P of pressure;

Alleviate the pressure in the cavity (312) and open the Crossover valve (305) and note the actuation of the Crossover Valve (305) with ROV (703) or by way of the sensor module (119);

Determine the integrity of the annulus wing valve (304) again pressurizing the same cavity (312) already previously pressurized (noting the behavior of the cavity (315);

Equally determine the integrity of the Master Annulus valve (302) towards WCT to the annulus A (211);

Alleviate the pressure of the block of the WCT, draining to the compensating reservoir (104) and note whether there is a rise in pressure. This test can check the integrity of the Master production (301) and master Annulus (302) valves in the correct direction;

Close Crossover valve (305);

Open Master Production valve (301);

Note whether there is pressure above the SSSD (209) and drain, if necessary, to the compensating reservoir (104);

Measure the flow by way of the SSSD (209);

Close Master production (301);

Drain pressure;

Open Crossover Valve (305) and Master annulus Valve (302);

Note the pressure in the annulus (211);

Drain, if necessary, to the compensating reservoir (104); and

Measure the flow.

The invention claimed is:

1. A system for monitoring abandoned subsea wells with a Wet Christmas Tree (WCT), by comprising:

a) a Control Module and, on a top of said Control Module, a mechanical interface for coupling on an installation tool of the Control Module jointly with an abandonment cap;

b) At least one hydraulic control line connected to the abandonment cap for pressurizing and depressurizing control lines of, at least, four valves namely: Master Production valve and Master Annular valve, Crossover valve and Annulus Intervention valve;

c) At least one line for pressurizing and depressurizing at least one high collapse resistance (HCR) line and pressurizing four cavities as follows a first cavity, a second cavity, a third cavity and a fourth cavity of the WCT;

d) Pressure sensors for continuously monitoring:

first pressures in the control lines of at least the Master production valve, the Master annular valve, the Crossover valve and the Annulus Intervention valve, second pressures in the at least one HCR line, and third pressures in the four cavities of the WCT;

e) Position sensors of the at least four valves of the WCT, to determine a partial or total opening and closing of the Master production valve and the Master annular valve, the Crossover valve and the Annulus Intervention valve;

f) hydrocarbon detectors in the four cavities of the WCT by way of the at least one line for pressurizing and depressurizing the at least one HCR line;

g) a compensating reservoir, recoverable by Remote Operating Vehicle (ROV), to alleviate the third pressures in the four cavities of the WCT and to store hydrocarbons;

h) an accumulator module to supply hydraulic power to allow the at least one hydraulic control line for pressurizing and depressurizing the control lines of the at least four valves of the WCT, for opening and closing the Master Production valve, the Master Annular valve, the Crossover valve and the Annulus Intervention valve;

i) a flow meter for calculating flow of the at least four valves over time and recording values measured for subsequent analysis;

j) a control system for actuating the Master Production valve, the Master Annular valve, the Crossover valve and the Annulus Intervention valve; and k) a Communication Module coupled beneath the ROV to perform a communication with the control system by way of an electric jumper and supply the hydraulic power to the control system by way of an hydraulic jumper.

2. The system according to claim 1, wherein: the Control Module comprises a communication system for sending to the Control Module record, over time, of the third pressures in the four cavities and the flow of the at least four valves of the WCT and a presence of the hydrocarbons.

3. The system according to claim 1, wherein the Control Module comprises a data module, recoverable by the ROV to obtain all records on the third pressures of the four cavities, a presence of the hydrocarbons, the flow of the at least four valves at intervals set by an operator and position of the Master Production valve, the Master Annular valve, the Crossover valve and the Annulus Intervention valve.

4. The system according to claim 1, wherein: the Control Module comprises the at least one hydraulic control line for actuation of the at least four valves of the WCT and a production adapter base (PAB).

5. The system according to claim 1, wherein the Control Module comprises a sensor module for detecting position of the at least four valves of the WCT by way of the position sensors installed in the position of the at least four valves as an indication panel.

6. The system according to claim 1, the Control Module comprises a circulation module, endowed with a circulation valve for communication between the four cavities in the WCT.

7. The system according to claim 1, wherein, alternatively, the Control Module is installed in the WCT with a system of horizontal connection lines jointly with an horizontal abandonment cap of a Flowline Hub (FLH).

8. The system according to claim 1, wherein alternatively comprising three modified abandonment caps, installed with three respective modules.

9. The system according to claim 8, wherein the Control Module:

a) is installed jointly with the abandonment cap of a Production Umbilical Mandrel (PUM);

b) is endowed with an interface for hydraulic feed, by way of an HCR production hose to a Production Pressure Register Module and the interface for the hydraulic feed by way of an annular HCR hose to an Annual Pressure Register Module;

c) is endowed with a first hydraulic line for connection to a fifth cavity;

d) is endowed with a second hydraulic line for connection to a sixth cavity; and e) is endowed with a second interface for connecting the hydraulic jumper to the WCT for controlling the at least four valves of the WCT.

10. A method using an assistance from the system according to claim 1, for said monitoring the abandoned subsea wells with the Wet Christmas Tree (WCT), said method comprising following steps:

A) Installing the Control Module jointly with the abandonment cap;

b) With an assistance of said Control Module continuously record and store data on the third pressures in the four cavities and a presence of the hydrocarbons and on a composition of the hydrocarbons;

c) In an event of leakage by way of the at least four valves over a limit or the presence of the hydrocarbons, or spurious opening of the at least four valves, a warning module of the Control Module is being detached and transmitting location signals of the abandoned subsea wells and abnormal data on an abnormality;

d) Once an interval between periodic inspections has elapsed, sending a Remote Operating Vehicle Support Vessel (RSV) of the ROV to monitor the abandoned subsea wells;

e) Descend the ROV with the communication module of the ROV coupled;

f) With an assistance of the ROV, make a connection of the electric jumper of the communication module to an electric connector of the control Module;

g) with the assistance of the ROV connecting the hydraulic Jumper of the Communication Module to an hydraulic receptacle in the Control Module;

h) Perform an integrity test of a Wing Production valve and the master Production valve with an assistance of the control system of the control module pressurizing the first cavity between the Master Production valve and the Wing Production valve and noting whether there is a drop in a fourth pressure in the first cavity and rise in the fourth pressure in the first cavity and if so, calculate the flow of the at least four valves;

i) Alleviate the fourth pressure in the first cavity and open the Crossover valve and note actuation of the Crossover Valve with the ROV or by way of a sensor module;

j) Determine an integrity of an annular wing valve again pressurizing the first cavity already previously pressurized and noting a behavior of the fourth cavity;

k) Determine an integrity of the Master Annular valve towards the WCT to an annular A of a well of the abandoned subsea wells;

l) Alleviate a pressure of a block of the WCT, draining to the compensating reservoir and note whether there is a rise in the pressure of the block;

m) Close the Crossover valve;

n) Open the Master Production valve;

o) Note whether there is the pressure of the block above a Subsurface Safety Device (SSSD) and drain, if necessary, to the compensating reservoir;

p) Measure a first flow of the SSSD;

q) Close the Master production valve;

r) Drain the pressure of the block;

s) Open the Crossover Valve and the Master annular Valve;

t) Note the pressure of the block on the annular A;

u) Drain, if necessary, the compensating reservoir; and v) Measure the first flow of the SSSD.

11. The method according to claim 10, installing a Production Pressure Register Module on the abandonment cap and an Annual Pressure Register Module on the abandonment cap.

* * * * *